US005732587A

United States Patent [19]

Maeda et al.

[11] Patent Number: 5,732,587

[45] Date of Patent: Mar. 31, 1998

[54] METALLIC WORKPIECE HAVING TO-BE-IRONED SECTION AND METHOD FOR FORMING THE SAME

[75] Inventors: Akihiro Maeda, Okazaki; Kunihiko Araki, Kyoto, both of Japan

[73] Assignees: Mitsubishi Jidosha Kogyo Kabushiki Kaisha, Tokyo; Heian Manufacturing Co., Ltd., Kyoto, both of Japan

[21] Appl. No.: 806,143

[22] Filed: Feb. 25, 1997

[30] Foreign Application Priority Data

Feb. 26, 1996 [JP] Japan ..... 8-038157

[51] Int. Cl.[6] ..... B21D 22/00; B21D 22/21

[52] U.S. Cl. ..... 72/348; 72/391.2

[58] Field of Search ..... 72/348, 379.2, 72/379.4, 377, 354.6, 354.2, 333, 327, 335, 344, 391.2, 370, 356, 349

[56] References Cited

U.S. PATENT DOCUMENTS 3,733,880 5/1973 Hansson ..... 72/348

*Primary Examiner*—Lowell A. Larson
*Assistant Examiner*—Rodney Butler

[57] ABSTRACT

A metallic workpiece has a to-be-ironed section to be shaped by means of a punch member. The to-be-ironed section is ironed by moving the punch member in a first direction with a side face of the punch member pressed against the surface of the to-be-ironed section and then moving the punch member in a second direction opposite to the first direction. The to-be-ironed section has a front end situated on the front side with respect to the moving direction of the punch member when the punch member moves in the second direction. Before the workpiece is ironed, a gentle slope for preventing burrs, continuous with the front end of the to-be-ironed section, and a bevel portion are formed on the workpiece. A tilt angle between the gentle slope and a line extending along the surface of the to-be-ironed section is at about 30°. The angle of the bevel portion is at 45° or thereabout. Secured between the gentle slope and the side face of the punch member is a gap, which absorbs a distortion of the metallic structure of the surface portion of the to-be-ironed section formed on the side of the front end thereof as the punch member moves in the second direction.

8 Claims, 8 Drawing Sheets

METALLIC WORKPIECE HAVING TO-BE-IRONED SECTION AND METHOD FOR FORMING THE SAME

BACKGROUND OF THE INVENTION

The present invention relates to a metallic workpiece having a to-be-ironed section to be shaped by ironing and a forming method for the workpiece.

In metallic products, e.g., mechanical parts, perforated metallic parts, etc., into desired shapes by plastic processing such as forging or upsetting, the products sometimes may be ironed to be finished with high accuracy. Ironing is effected in a manner such that a punch member is moved along the surface of a desired part (section to be ironed) of a workpiece to be shaped, with a side face of the punch member pressed against the section to be ironed so that the to-be-ironed section is reduced in thickness.

FIGS. 12A and 12B show an example of an ironing process. A metallic workpiece 101 shown in FIG. 12A is plastically processed in advance into a shape similar to that of a final product by upsetting. The surface of a part (to-be-ironed section 102) of the workpiece 101 to be shaped is ironed by means of a punch member 103. In a press fitting stage, the punch member 103 moves in the direction of arrow S1 with its side face 103*a* pressed against the surface of the to-be-ironed section 102 so as to reduce the thickness of the section 102. In a return stage, moreover, the punch member 103 moves in the direction of arrow R1 in FIG. 12B, thereby returning to its original position. In this series of stages (press fitting stage and return stage), the to-be-ironed section 102 of the workpiece 101 is finished having a given size and shape.

As the punch member 103 moves in the direction of arrow R1 in the aforesaid ironing process, a burr 104 may be formed projecting from an end of the to-be-ironed section 102, as shown in FIG. 12C, in some cases. The burr 104 is supposed to be formed from the following cause.

When the punch member 103 presses the surface of the to-be-ironed section 102 while moving in the direction of arrow S1 in the press fitting stage, the section 102 is subjected to a force to push back the side face 103*a* of the member 103, that is, stress indicated by arrow P in FIG. 12B. As the punch member 103 moves in the direction of arrow R1 in the return stage, therefore, a substantial frictional resistance is produced between the side face 103*a* of the member 103 and the surface of the to-be-ironed section 102. This frictional resistance causes a behavior such that the surface of the to-be-ironed section 102 is dragged in the direction R1 by the punch member 103. As a result, an end 102*a* of the to-be-ironed section 102, situated on the front side with respect to the moving direction of the punch member 103, is distorted in the direction R1. This distortion is believed to result in the development of the burr 104 that projects from the end of the to-be-ironed section 102.

If the product has the burr 104 thereon in this manner, its appearance is marred, and besides, it cannot enjoy desired properties in some cases. Removing the burr requires a deburring stage separate from the ironing process, thus entailing an increased number of processes or stages. Accordingly, there has been a demand for a measure to counter development of burrs during the ironing process.

BRIEF SUMMARY OF THE INVENTION

Accordingly, the object of the present invention is to provide a metallic workpiece, of which a to-be-ironed section can be restrained from being burred at its end as it is ironed, and a forming method for the workpiece.

In order to achieve the above object, a workpiece according to the present invention is a metallic workpiece to be ironed by means of a punch member having a side face, comprising: a to-be-ironed section adapted to be shaped as the punch member moves in first and second directions in a manner such that the to-be-ironed section is pressed by the side face of the punch member so as to be reduced in thickness, the to-be-ironed section having a front end situated on the front side with respect to the moving direction of the punch member when the punch member moves in the second direction; and a gentle slope formed on that part of the workpiece which is opposed to the side face of the punch member, so as to be continuous with the front end of the to-be-ironed section, the gentle slope defining, in conjunction with the side face of the punch member, a gap for absorbing a distortion of the surface portion of the to-be-ironed section formed on the side of the front end thereof as the punch member moves in the second direction.

A frictional force is produced between the surface of the to-be-ironed section and the side face of the punch member as the punch member moves in the second direction, just as in the conventional case. According to the invention, however, the gentle slope is continuous with the end of the to-be-ironed section, so that the distortion of the metallic structure of the surface portion of the to-be-ironed section at the end thereof can be absorbed by the gap between the gentle slope and the side face of the punch member. In order to restrain a steel workpiece from being burred, the tilt angle of the gentle slope, that is, the angle $\alpha$ between the gentle slope and a line extending along the surface of the to-be-ironed section, must be adjusted to less than 45°. Development of burrs can be prevented most effectively by adjusting the tilt angle $\alpha$ to about 30°.

In order to obtain a desired function, some kinds of workpieces may be formed having a bevel portion that is continuous with the gentle slope and inclined at an angle (e.g., 45°) wider than the tilt angle $\alpha$ of the gentle slope. These workpieces having the bevel portion and the gentle slope are applicable to the teeth of a ring gear around a flywheel in an engine starting system, for example.

A forming method for a workpiece according to the present invention comprises: a preforming process for forming the metallic workpiece into a shape similar to that of a final product by plastic processing; and an ironing process for shaping a to-be-ironed section of the workpiece by means of a punch member after the plastic processing, the ironing process including a press fitting stage for moving the punch member in a first direction in a manner such that a side face of the punch member is pressed against the to-be-ironed section so as to reduce the thickness of the to-be-ironed section, and a return stage for moving the punch member in a second direction opposite to the first direction after the press fitting stage, the preforming process including a stage for forming a gentle slope for preventing burrs inclined at a narrow tilt angle less than 45° to a line extending along the surface of the to-be-ironed section, in a region on the workpiece continuous with a front end of the to-be-ironed section with respect to the second direction in which the punch member moves.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Referring now to FIGS. 1 to 8E, a first embodiment of the present invention will be described.

Figure 1:
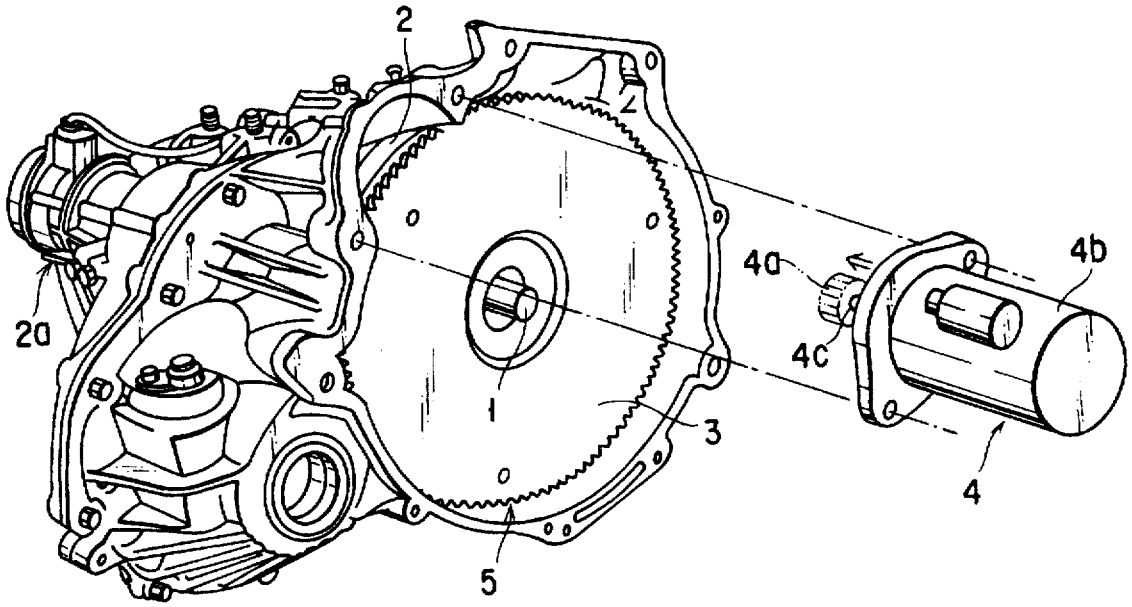
FIG. 1 is a perspective view showing a transmission apparatus having a ring gear according to a first embodiment of the present invention and a starter motor.
Figure 2:
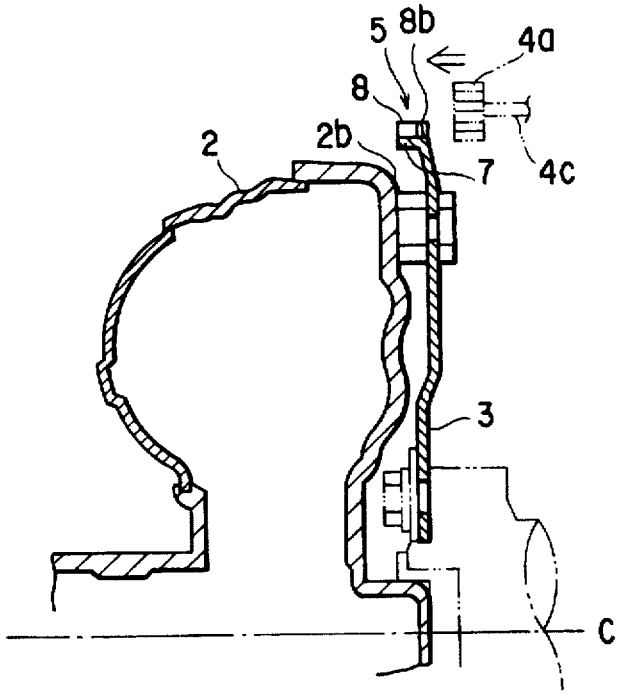
FIG. 2 is a sectional view of a part of the transmission apparatus shown in FIG. 1.

FIG. 1 shows an exterior view of an automatic transmission apparatus for an automobile, for example. This transmission apparatus comprises an input shaft section 1, which is rotated by means of an engine (not shown). The input shaft section 1 is connected to a transmission unit 2*a* through a torque converter 2. As shown in FIG. 2, a cover 2*b* envelops a converter turbine (not shown) of the converter 2. A drive plate 3, which doubles as a flywheel, is attached to the front portion of the cover 2*b*.

The drive plate 3 is in the form of a disk, and a ring gear 5, which can engage a pinion 4*a* of a starter 4, is formed integrally with the outer peripheral portion of the plate 3.

The starter 4 includes the pinion 4*a* and a motor unit 4*b* for rotating the pinion 4*a*. The pinion 4*a* is provided on the tip end of a rotating shaft 4*c* of the starter 4. The shaft 4*c* is movable in the axial direction of the motor unit 4*b*, and it projects toward the ring gear 5 when the unit 4*b* is actuated. When the pinion 4*a* engages the gear 5, the rotating shaft 4*c* of the motor unit 4*b* rotates.

Figure 3A:
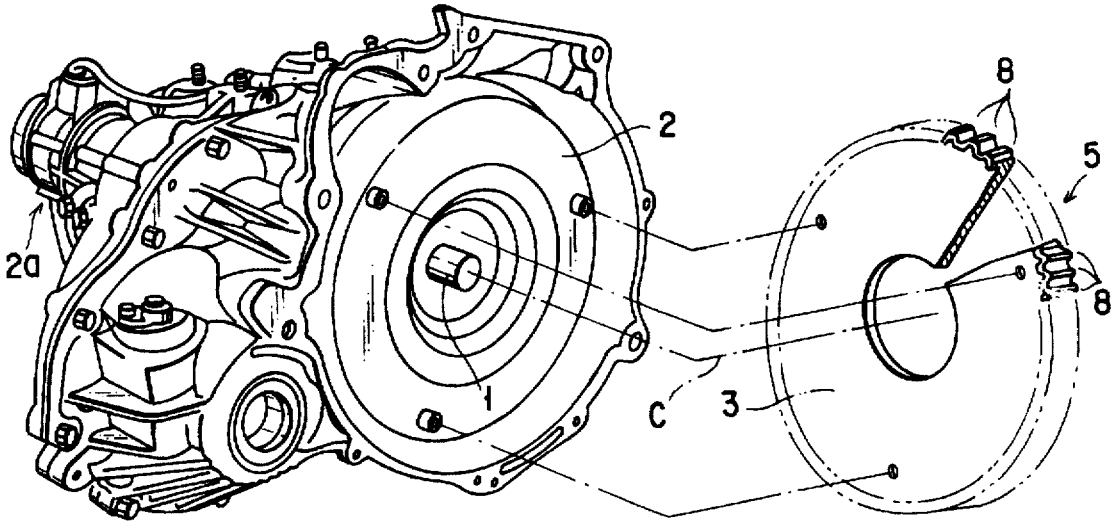
FIG. 3A is a perspective view showing the transmission apparatus of FIG. 1 with its ring gear off.
Figure 3B:
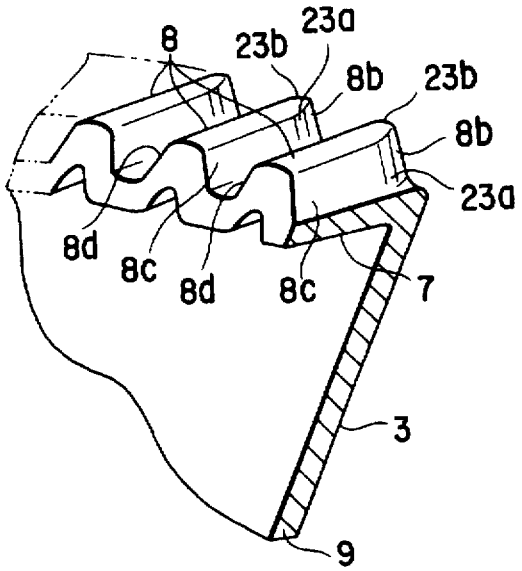
FIG. 3B is an enlarged perspective view showing a part of the ring gear shown in FIG. 3A.

As shown in FIGS. 3A and 3B, the ring gear 5 is formed from a sheet metal material, such as steel, so as to be integral with the drive plate 3. A ring-shaped peripheral wall 7 is formed by bending the outer peripheral portion of a circular sheet metal material of the drive plate 3 outward so as to extend substantially parallel to an axis C of the plate 3. Thereafter, a large number of teeth 8 are formed on the outer peripheral surface of the peripheral wall 7, arranged at regular pitches in the circumferential direction. Each of these teeth 8 is formed having a bevel portion 8*b*, which facilitates the engagement with the pinion 4*a* at the start of engine operation.

Figure 4A:
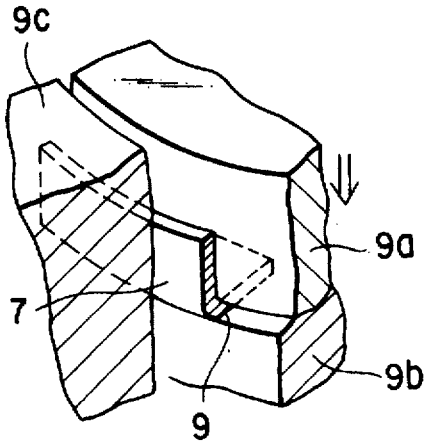
FIG. 4A is a perspective view showing a part of a die set for bending the peripheral edge portion of a sheet metal material for the ring gear.
Figure 4B:
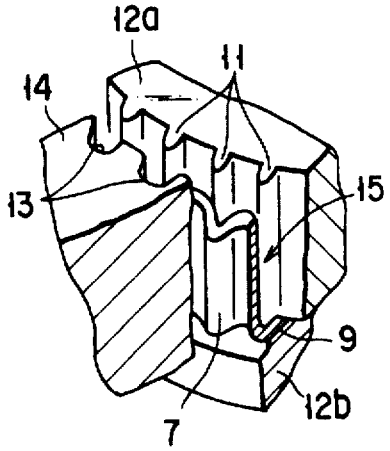
FIG. 4B is a perspective view showing a part of a die set for preforming the teeth of the ring gear.

More specifically, a flat steel plate 9 in the form of a punched disk is used as the material of the ring gear 5 that doubles as the drive plate 3. As shown in FIG. 4A, the flat plate 9 is interposed between upper and lower punches 9*a* and 9*b*. The peripheral wall 7 is formed on the outer peripheral portion of the drive plate 3 by drawing the outer peripheral portion of the flat plate 9 by means of a die 9*c*. In a preforming process, the flat plate 9 is interposed between upper and lower punches 12*a* and 12*b*, as shown in FIG. 4B. Drawing is effected by causing the peripheral wall 7 to be sandwiched between the upper punch 12*a* and a die 14. In this manner, an intermediate formed product 15 is obtained. A plurality of ridges 11, fit for the internal configuration of the teeth 8 to be formed, are formed at predetermined intervals on the outer peripheral surface of the upper punch 12a. A plurality of recesses 13, fit for the external configuration of the teeth 8 to be formed, are formed at predetermined intervals on the inner peripheral surface of the die 14, in positions corresponding to the ridges 11, individually.

Figure 4C:
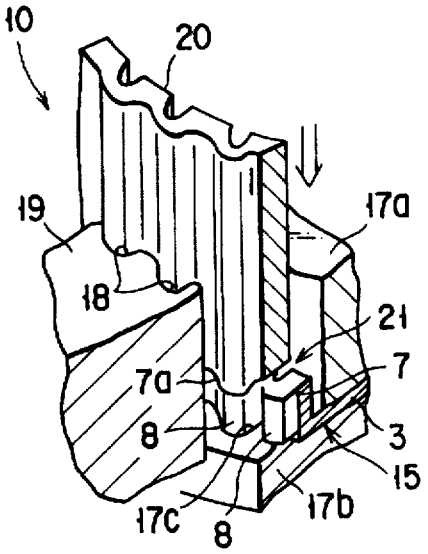
FIG. 4C is a perspective view showing a part of a die set for upsetting the teeth of the ring gear.

In this preforming process, moreover, the peripheral wall 7 of the intermediate formed product 15 is held between upper and lower punches 17a and 17b and a die 19, as shown in FIG. 4C. Then, upsetting is carried out in a manner such that the peripheral wall 7 is pressurized from the side of its distal end 7a by means of a punch 20. After undergoing a series of plastic processing stages described above, a workpiece 21 is formed having a shape similar to that of a final product. The upper punch 17a is provided with a plurality of ridges (not shown) fit for the internal configuration of the teeth 8 to be formed. The die 19 is formed with a plurality of tooth-shaped portions 18 fit for the external configuration of the teeth 8 to be formed. The lower punch 17b is formed with slopes 17c that are used in forming the bevel portions 8b and gentle slopes 23a and 23b, which will be mentioned later.

As the aforementioned preforming process is carried out, the teeth 8 corresponding to the tooth-shaped portions 18 of the die 19 are formed on the workpiece 21. These teeth 8 are formed individually with the bevel portions 8b that are formed along the slopes 17c of the lower punch 17b. The gentle slopes 23a and 23b for preventing burrs are formed on each of the teeth 8 in the preforming process.

Figure 7:
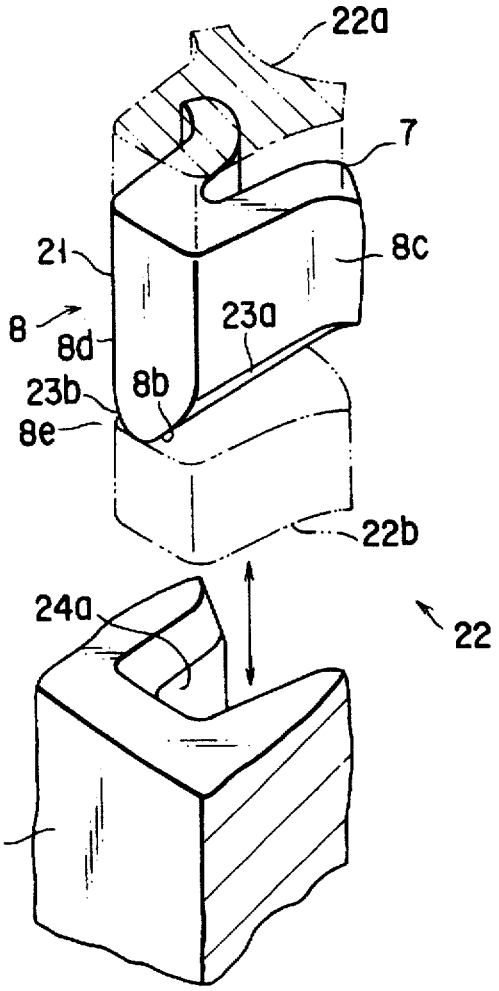
FIG. 7 is a perspective view showing a part of a diet set used in ironing the ring gear.
Figure 8A:
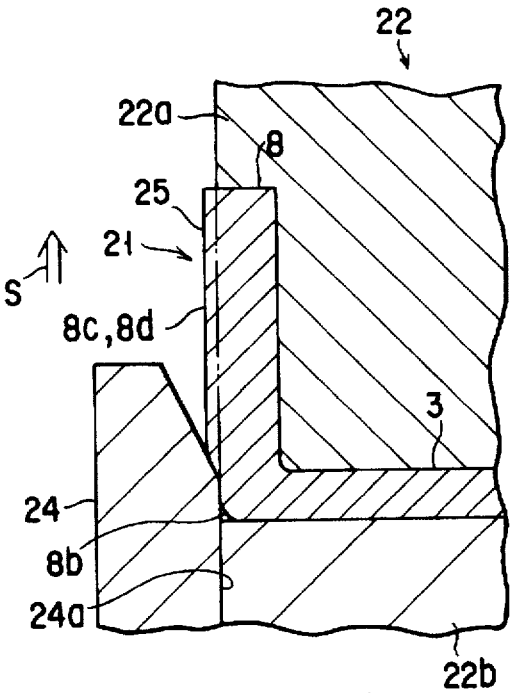
FIG. 8A is a sectional view partially showing a workpiece and the die set along with a punch member moving in a first direction.

Before explaining the function of the gentle slopes 23a and 23b, an ironing process will be described. In carrying out ironing, the workpiece 21 is fixed by means of a die set 22 that includes upper and lower dies 22a and 22b, as shown in FIGS. 7 and 8A. In a press fitting stage, thereafter, a side face 24a of a punch member 24, which is shaped corresponding to the teeth 8, is moved in a first direction indicated by arrow S along the surface of a to-be-ironed section 25 in a manner such that it presses the surface of the section 25. In a return stage, thereafter, the punch member 24 moves in a second direction indicated by arrow R in FIG. 8B. The surface of the to-be-ironed section 25 to be shaped can be finished with high accuracy as it is rubbed with the punch member 24 so that the thickness of the section 25 is reduced.

In the case of this embodiment, the side face 24a of the punch member 24, which is adapted to be in contact with the teeth 8 of the workpiece 21, has a shape and size such that the thickness of both side portions of each tooth 8 can be reduced. As the punch member 24 reciprocates in the aforesaid directions S and R, therefore, the opposite side portions of the teeth 8 are shaped so as to have a given size and shape, and the surface of the teeth 8 is smoothed.

Figure 5:
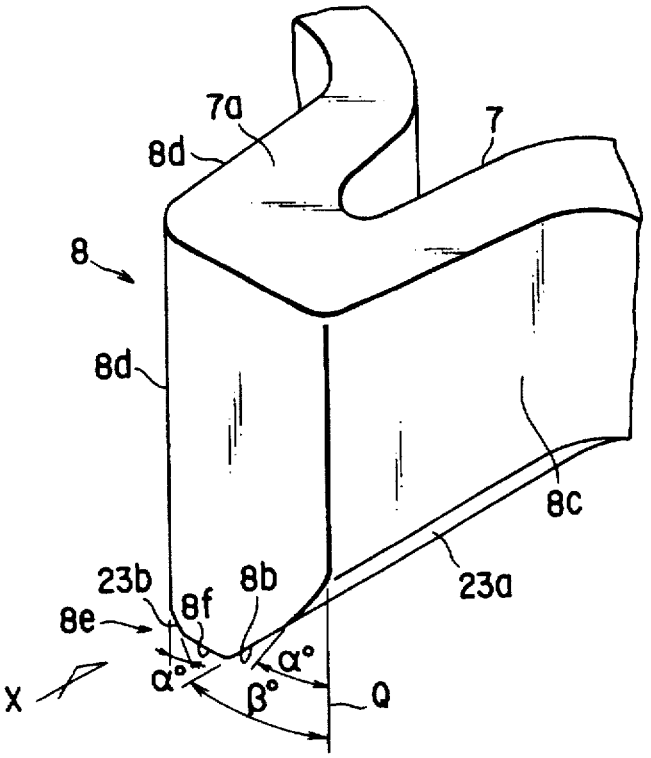
FIG. 5 is an enlarged perspective view showing a part of the ring gear.
Figure 6:
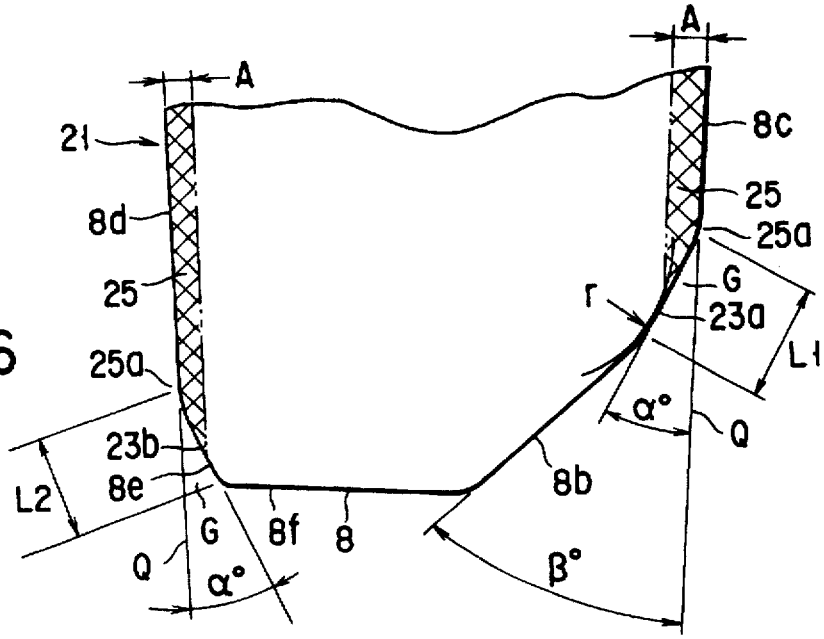
FIG. 6 is a front view of a tooth of the ring gear taken in the direction of arrow X in FIG. 5.

The following is a description of the function of the gentle slopes 23a and 23b. As shown in FIGS. 5 and 6, for example, the slopes 23a and 23b are formed on the distal end side of opposite side portions 8c and 8d of each tooth 8 to be ironed by means of the punch member 24. In other words, the gentle slopes 23a and 23b are formed on the front side of the to-be-ironed section 25 with respect to the second direction in which the punch member 24 moves. More specifically, the one gentle slope 23a is formed between an end 25a of the to-be-ironed section 25 and the bevel portion 8b at the one side portion 8c corresponding to the bevel portion 8b. The other gentle slope 23b is formed at a corner portion 8e of the other side portion 8d where the to-be-ironed section 25 is continuous with an end face 8f of each tooth 8.

The respective lengths L1 and L2 (shown in FIG. 6) of the gentle slopes 23a and 23b are adjusted so that the slopes 23a and 23b can partially remain even though the thickness of the to-be-ironed section 25 is reduced by an ironing margin A in the ironing process. In other words, the front end of the gentle slope 23a that is formed on the one side portion 8c of each tooth 8 is continuous with the rear end of the bevel portion 8b. The rear end of the gentle slope 23a is continuous with the surface of the to-be-ironed section 25. An angle (tilt angle) α between the gentle slope 23a and a line Q along the surface of the to-be-ironed section 25 is narrower than an angle β of the bevel portion 8b. The angle β of the bevel portion 8b is set at a value (e.g., 45°) such that the pinion 4a and the ring gear 5 can smoothly engage each other as the pinion 4a projects toward the teeth 8 of the gear 5 at the start of engine operation.

The tilt angle α of the gentle slopes 23a and 23b is adjusted so that no burrs are created when the punch member 24 slides in the second direction R on the surface of the to-be-ironed section 25. That is, the gentle slopes 23a and 23b are inclined so that a gap G can be secured between each gentle slope 23a or 23b and the side face 24a of the punch member 24 such that the metallic structure of the surface portion of the to-be-ironed section 25 on the side of the front end 25a is allowed to be deformed in the direction R when the surface of the section 25 is urged to be dragged in the direction R as the punch member 24 moves in the direction R, and that the metallic structure can be prevented from being dragged in the shape of burr by the punch member 24.

In the case where the workpiece 21 is made of steel, the tilt angle α is adjusted to a narrow angle of of less than 45° (preferably about 30°). The punch member 24 is formed of an iron-based alloy harder than the workpiece 21. A cross-hatched region in FIG. 6 is a region corresponding to the ironing margin A by which the thickness is reduced in the ironing process. For ease of understanding, the ironing margin A is described exaggeratedly in FIG. 6. However, the actual ironing margin A has a small value of micron order (several micrometers to hundreds of micrometers).

Also, the angle (tilt angle) α between the gentle slope 23b, which is formed on the other side portion 8d of each tooth 8, and the line Q along the surface of the to-be-ironed section 25 is adjusted to less than 45°, preferably about 30°. If these gentle slopes 23a and 23b are formed on the workpiece 21, the end 25a of the to-be-ironed section 25 can be prevented from being burred even when the punch member 24 moves in the second direction R during the ironing process. The following is a description of the reason for this.

Figure 8B:
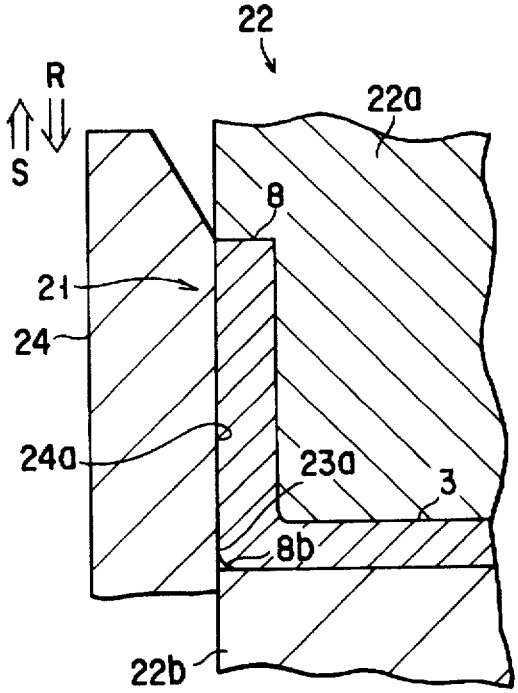
FIG. 8B is a sectional view partially showing the workpiece and the die set along with the punch member having just finished moving in the first direction.
Figure 8C:
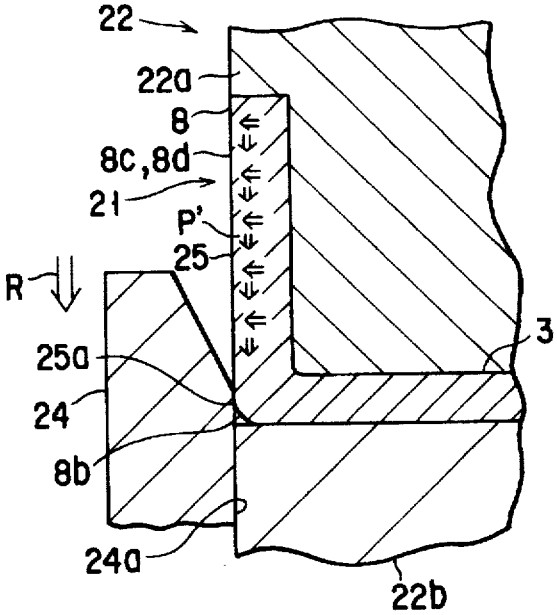
FIG. 8C is a sectional view partially showing the workpiece and the die set along with the punch member moving in a second direction.
Figure 8D:
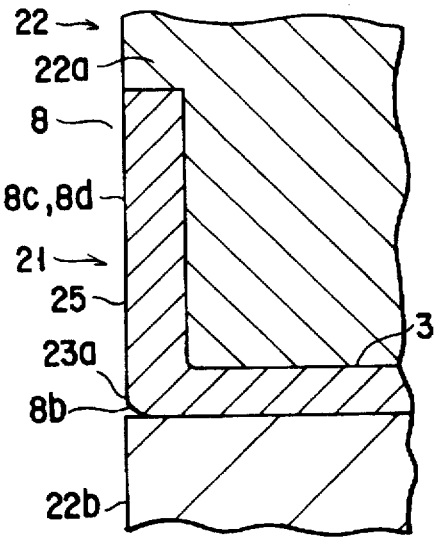
FIG. 8D is a sectional view partially showing the workpiece and the die set having undergone ironing.
Figure 8E:
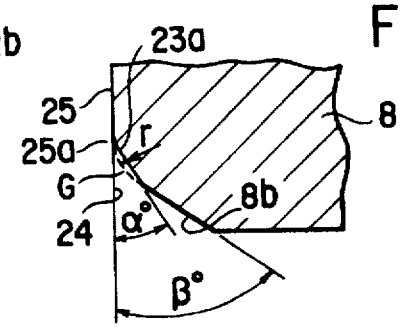
FIG. 8E is an enlarged sectional view partially showing the workpiece.

In ironing the teeth 8, the punch member 24 moves in the first direction (indicated by arrow S), as shown in FIG. 8B, from the position for the initial stage of the press fitting stage shown in FIG. 8A, for example. As this is done, the side face 24a of the punch member 24 presses and rubs against the respective surfaces of the opposite side portions 8c and 8d of each tooth 8, thereby shaping the side portions 8c and 8d. In the return stage, the punch member 24 moves in the second direction (drawing direction) indicated by arrow R in FIG. 8c. As this is done, the surface of the to-be-ironed section 25 is urged to be elastically restored toward the side face 24a of the punch member 24. Accordingly, a great frictional resistance is produced between the punch member 24 and the to-be-ironed section 25. This frictional resistance causes a part of the metallic structure of the surface portion of the to-be-ironed section 25 to be dragged in the moving direction of the punch member 24 as indicated by arrow P', whereupon a slight distortion develops.

The gentle slopes 23a and 23b, which recede from the side face 24a of the punch member 24 at the narrow tilt angle α, are formed on that end 25a of the to-be-ironed section 25 which is situated on the front side in the moving direction of the member 24. Even though the to-be-ironed section 25 is dragged in the direction R by the punch member 24, therefore, the deformation of the metallic structure of the surface portion of the section 25 at the end 25*a* thereof can be absorbed by the gap G between the gentle slope 23*a* and the member 24, as indicated by broken line in FIG. 8E. Since the tilt angle α of the gentle slopes 23*a* and 23*b* is adjusted to the small value of less than 45° (preferably about 30°), moreover, the deformed metallic structure of the surface portion at the end 25*a* can be prevented from being dragged in the shape of burr by the punch member 24. Although a convex surface with a curvature radius r (shown in FIG. 6) is formed between the bevel portion 8*b* and the gentle slope 23*a*, as a result, the end 25*a* of the to-be-ironed section 25 can be restrained from being burred.

Burrs can be restrained from developing by adjusting the tilt angle α of the gentle slopes 23*a* and 23*b* to a value less than 45°. Further, development of burrs can be prevented most effectively by adjusting the tilt angle α to about 30° or within the range 15°≦α≦30° in some cases. In a test conducted by the inventors hereof, a workpiece having a bevel portion 23' inclined at 45°, as shown in FIG. 9D, was ironed. Thereupon, a burr 26 with a length of about 0.4 mm developed on the end of the to-be-ironed section 25.

Figure 9A:
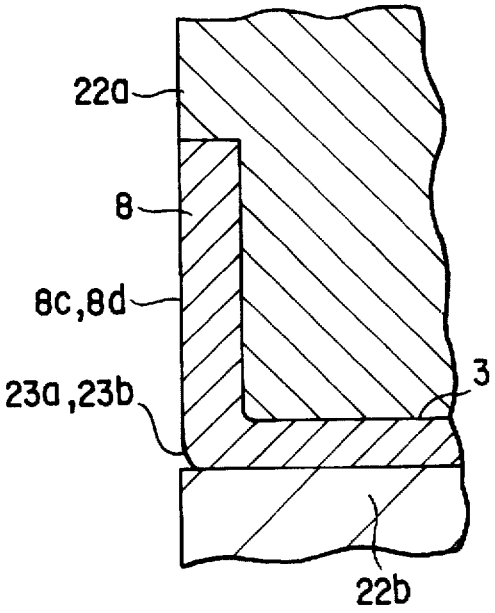
FIG. 9A is a sectional view partially showing a modification of the workpiece to which the invention is applied and the mold.
Figure 9B:
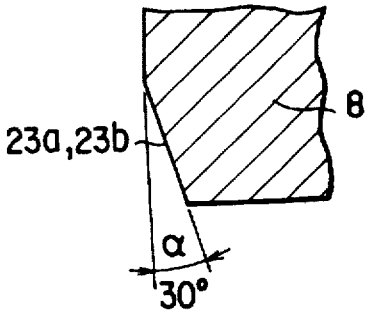
FIG. 9B is an enlarged sectional view partially showing the workpiece of FIG. 9A.
Figure 9C:
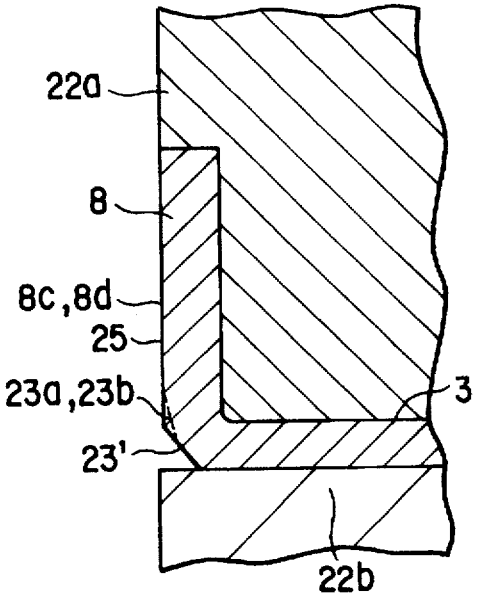
FIG. 9C is a sectional view partially showing a workpiece having a 45° bevel portion and the die set.
Figure 9D:
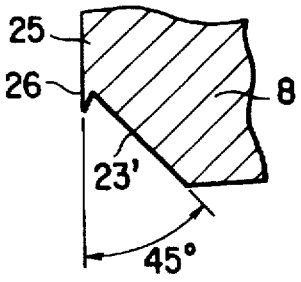
FIG. 9D is a sectional view showing the workpiece of FIG. 9C with a burr thereon.

When a workpiece previously formed having the gentle slopes 23*a* and 23*b* with the tilt angle α of less than 45° was ironed, as shown in FIGS. 9A and 9B, it was confirmed that burrs would be able to be restrained from developing. When the tilt angle α was set at 30°, in particular, development of burrs was able to be restrained completely. Also, it was found that burrs would be able to be prevented from developing by providing the gentle slopes 23*a* and 23*b* with the tilt angle α of less than 45° (e.g., about 30°) between the bevel portion 23' inclined at 45° and the to-be-ironed section 25, as shown in FIG. 9C.

In short, development of burrs was effectively restrained by minimizing the tilt angle α of the gentle slopes 23*a* and 23*b* in consideration of the function of products subjected to ironing. However, the lower limit of the tilt angle α of the gentle slopes 23*a* and 23*b* should be set at 2°, since burrs sometimes cannot be restrained from developing if the tilt angle α is less than 2°.

If the embodiment described above is applied to the teeth 8 of the ring gear 5 of the starter 4, the pinion 4*a* and the ring gear 5 can engage each other very smoothly at the start of engine operation. This is possible because the ring gear 5 is formed having the gentle slopes 23*a* and 23*b* with the tilt angle α narrower than that of the bevel portion 8*b* for easier engagement with the pinion 4*a*, the slopes 23*a* and 23*b* and the bevel portion 8*b* being continuous with one another. Thus, when the pinion 4*a* projects toward the ring gear 5 at the start of engine operation, a bevel portion (not shown) formed on the pinion 4*a* comes into contact with the bevel portion 8*b* of the ring gear 5, whereupon the pinion 4*a* is guided in a direction such that the pinion 4*a* and the gear 5 engage each other. Since the gentle slopes 23*a* and 23*b* are continuous with the bevel portion 8*b*, the pinion 4*a* can move smoothly to attain a given depth of engagement with the ring gear 5. Despite the presence of the gentle slopes 23*a* and 23*b*, the area of engagement between the pinion 4*a* and the ring gear 5 cannot be reduced substantially.

Figure 10A:
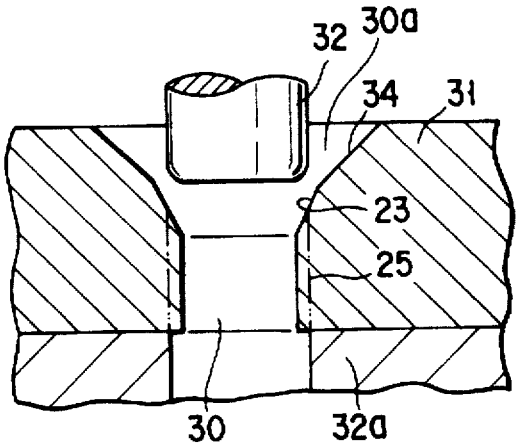
FIG. 10A is a partial sectional view showing a workpiece according to a second embodiment of the invention and a punch member 32.
Figure 10B:
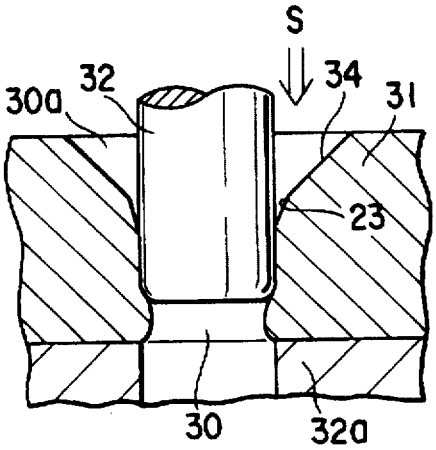
FIG. 10B is a sectional view showing the way the punch member is press-fitted into a hole in the workpiece shown in FIG. 10A.
Figure 10C:
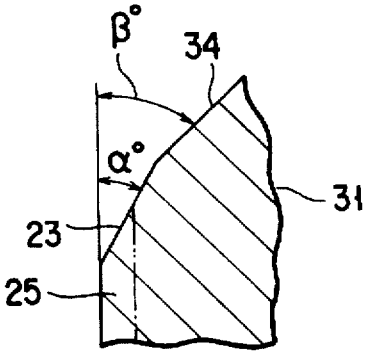
FIG. 10C is a sectional view showing a part of the workpiece of FIG. 10A.
Figure 10D:
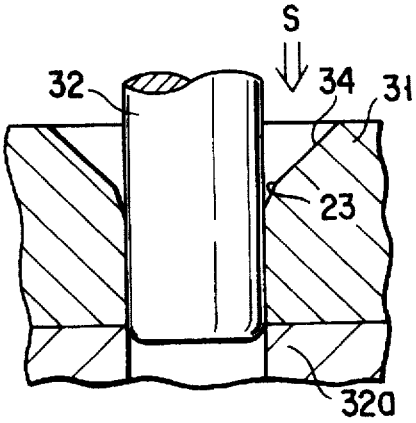
FIG. 10D is a sectional view showing the workpiece of FIG. 10A along with the punch member fitted entire in the hole in the workpiece.
Figure 10E:
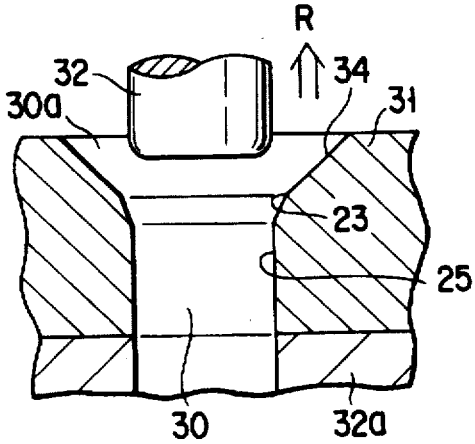
FIG. 10E is a sectional view showing the punch member having just drawn out of the hole in the workpiece.

Although the present invention has been described as being applied to the teeth 8 of the ring gear 5 according to the first embodiment, the invention may be also applied to any other mechanical parts than gears. FIGS. 10A to 10E show a second embodiment of the invention. According to this embodiment, a metallic workpiece 31 having a hole 30 previously formed by drilling, for example, is subjected to the aforementioned ironing operation. After the workpiece 31 is fixed to a die 32*a*, as shown in FIG. 10A, a punch member 32 is moved in the first direction S in a press fitting stage, as shown in FIG. 10B, whereupon the member 32 is inserted into the hole 30. In a return stage shown in FIGS. 10D and 10E, the punch member 32 is moved in the second direction R. Thus, the inner surface of the hole 30 is ironed and shaped by means of the punch member 32. A bevel portion 34 inclined at the angle β of about 45° is formed on an opening edge portion 30*a* of the hole 30.

Also in ironing the inner surface of the hole 30 in this manner, the end of the to-be-ironed section 25 will inevitably be burred in the return stroke of the punch member 32 unless any means is provided for preventing burrs. In order to restrain burrs from developing, therefore, the workpiece 31 according to this second embodiment, like the one according to the first embodiment, is formed having a gentle slope 23 with the tilt angle α (shown in FIG. 10C) of less than 45° (preferably about 30°), the slope 23 being continuous with the end of the to-be-ironed section 25. In FIGS. 10A to 10F, like reference numerals refer to like portions as are used in the first embodiment, and a description of those portions is omitted.

Figure 11:
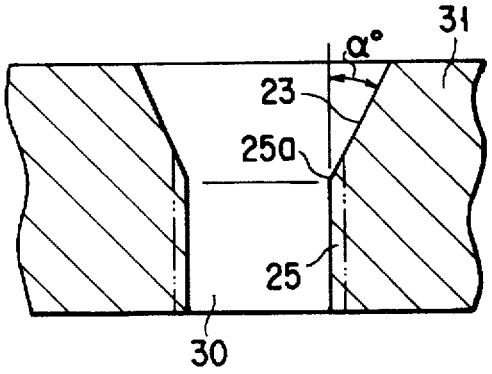
FIG. 11 is a sectional view showing a workpiece according to a third embodiment of the invention.
Figure 12A:
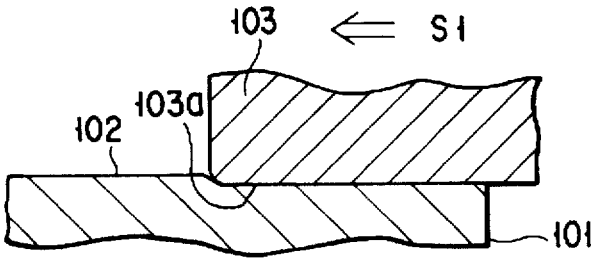
FIG. 12A (PRIOR ART)
FIG. 12A is a sectional view partially showing a conventional workpiece and a punch member.
Figure 12B:
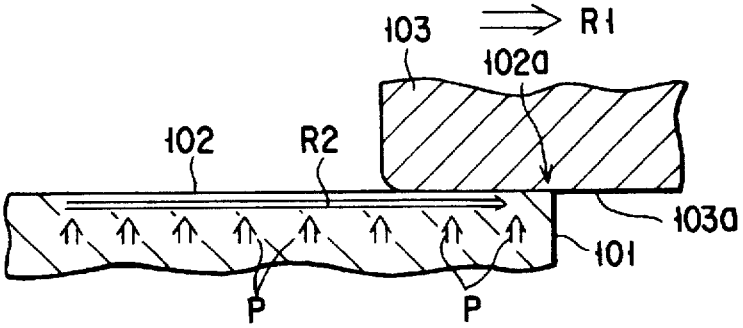
FIG. 12B (PRIOR ART)
FIG. 12B is a sectional view showing the workpiece and the punch member of FIG. 12A in a return stroke of the punch member.
Figure 12C:
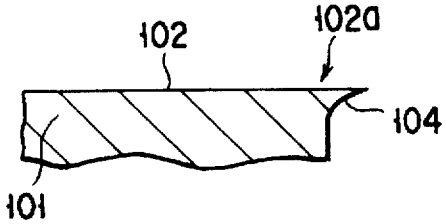
FIG. 12C (PRIOR ART)
FIG. 12C is a sectional view showing a part of the conventional workpiece having a burr thereon.

According to each embodiment described herein, the bevel portion 34 inclined 45°, for example, is formed on the end face of the workpiece 21 or 31 as mechanical parts. In carrying out the present invention, however, the bevel portion 34 is not essential. As in a third embodiment shown in FIG. 11, for example, development of burrs during the ironing operation may be restrained by forming only the burr-preventing gentle slope 23 with the tilt angle α of less than 45° on the opening edge portion of the hole 30 of the workpiece 31. It is to be understood, moreover, that the invention may be also applied to the case of finishing the outer surfaces of any other mechanical parts than the aforementioned ones and the case of finishing the inner peripheral surfaces of holes in various other metallic products.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A metallic workpiece to be ironed by means of a punch member having a side face, comprising:

a to-be-ironed section adapted to be shaped as the punch member moves in first and second directions in a manner such that the to-be-ironed section is pressed by the side face of the punch member so as to be reduced in thickness, the to-be-ironed section having a front end situated on the front side with respect to the moving direction of the punch member when the punch member moves in the second direction; and a gentle slope formed on that part of the workpiece which is opposed to the side face of the punch member, so as to be continuous with the front end of the to-be-ironed section, the gentle slope defining, in conjunction with the side face of the punch member, a gap for absorbing a distortion of the surface portion of the to-be-ironed section formed on the side of the front end thereof as the punch member moves in the second direction.

2. A workpiece according to claim 1, wherein a tilt angle between the gentle slope and a line extending along the surface of the to-be-ironed section is less than 45°.

3. A workpiece according to claim 1, wherein the length of said gentle slope is adjusted to a value such that the gentle slope partially remains after the thickness of the to-be-ironed section is reduced as the punch member moves in the first direction.

4. A workpiece according to claim 1, wherein said workpiece is a ring gear used in a starter of an engine and including teeth each formed having a bevel portion for guiding engagement with a pinion of the starter, and said gentle slope inclined at an angle narrower than the tilt angle of the bevel portion is formed between the bevel portion and the to-be-ironed section.

5. A workpiece according to claim 2, wherein the tilt angle of said gentle slope is at about 30°.

6. A workpiece according to claim 2, wherein the tilt angle of said gentle slope ranges from 15° to 30°.

7. A workpiece according to claim 4, wherein an angle between the bevel portion and the line extending along the surface of the to-be-ironed section is substantially at 45°, and the tilt angle between the gentle slope and the line ranges from 15° to 30°.

8. A forming method for a metallic workpiece, comprising:

a preforming process for molding the metallic workpiece into a shape similar to that of a final product by plastic processing; and an ironing process for shaping a to-be-ironed section of the workpiece by means of a punch member after the plastic processing, the ironing process including a press fitting stage for moving the punch member in a first direction in a manner such that a side face of the punch member is pressed against the to-be-ironed section so as to reduce the thickness of the to-be-ironed section, and a return stage for moving the punch member in a second direction opposite to the first direction after the press fitting stage, the preforming process including a stage for forming a gentle slope for preventing burrs inclined at a narrow tilt angle less than 45° to a line extending along the surface of the to-be-ironed section, in a region on the workpiece continuous with a front end of the to-be-ironed section with respect to the second direction in which the punch member moves.

* * * * *